United States Patent [19]

Bunn

[11] 4,151,764

[45] May 1, 1979

[54] PIPE WRENCH LOCKING DEVICE

[76] Inventor: Lorne Bunn, P.O. Box 1045, The Pas, Manitoba, Canada

[21] Appl. No.: 876,919

[22] Filed: Feb. 13, 1978

[51] Int. Cl.[2] ..... B25B 13/28

[52] U.S. Cl. ..... 81/100; 81/167

[58] Field of Search ..... 81/53 R, 100, 128, 155, 81/167

[56] References Cited

U.S. PATENT DOCUMENTS

| | | | |
|---|---|---|---|
| 1,036,585 | 8/1912 | Dolan | 81/167 X |
| 2,102,287 | 12/1937 | Smethers | 81/167 X |
| 3,578,307 | 5/1971 | Lock | 81/167 X |

*Primary Examiner*—James L. Jones, Jr.

*Assistant Examiner*—James G. Smith

*Attorney, Agent, or Firm*—J. L. Jones, Sr.

[57] ABSTRACT

On a conventional pipe wrench, an L-shaped lever arm has the short bisected arm segment cooperatively disposed over and secured by a fixed pivot to a linear extention of the threaded section of the adjustable pipe jaw. A free pivot disposed at the terminus of the bisected arm secures a roller between and in the short bisected arm segment. The L-shaped lever arm and pivoted roller are adaptively sized and shaped to provide a lock means for the pipe jaw when the lever handle is pressed down against the pipe wrench handle, locking the roller against the wrench handle by compressing the roller in detent against the wrench handle.

1 Claim, 2 Drawing Figures

PIPE WRENCH LOCKING DEVICE

BACKGROUND OF THE INVENTION

The wrench locking device of this invention is classified in Classes 81/53, 81/128 and the like.

Seaver, in U.S. Pat. No. 2,483,713 issued Oct. 4, 1949, discloses a pipe wrench with a link mounted lower jaw which cooperates with an adjustable and swingable upper jaw, so that the wrench will have a strong self-tightening grip. In U.S. Pat. No. 1,921,281 issued Aug. 8, 1933, Carlson discloses an adjustable locking tubing tong having a U-shaped frame adapted to fit around a pipe. There are pipe engaging jaws at one side of the U-shaped frame and an engager slidably mounted on the other side of the frame. A pivoted handle on the frame is so equipped that movement of the handle in forward direction will produce an inward movement of the engager against the pipe held in the frame. Baash et al discloses in U.S. Pat. No. 1,845,389 issued on Feb. 16, 1932 a tong for securing round pipes by operating the actuating line carried by the handle and securing the gripping jaws around a pipe. Pietsch discloses a wrench in U.S. Pat. No. 1,569,673 of Jan. 12, 1926, wherein a movable jaw can be quickly moved to any position with respect to a fixed jaw, and then locked in position.

SUMMARY OF THE INVENTION

A conventional pipe wrench has a coaxial linearly extended free pipe jaw of the required extension length. An L-shaped lever arm has a short bisected arm segment disposed over the extension arm and secured to the extension arm by a fixed pivot. A free pivot is disposed and secured at the terminus of the bisected arm segment, and the free pivot secures a roller between and in the bisected arm segment. The L-shaped lever arm, the roller, and the coaxial extension of the free pipe jaw are adaptively sized and shaped to provide a lock means for the pair of wrench jaws when the lever arm is pressed down against the pipe wrench handle, locking the roller against the pipe handle by compressing the roller in a maximum rotated detent position for the bisected short arm segment.

Included in the objects of this invention are:

To provide a wrench locking device for a conventional pipe wrench.

To provide a pipe wrench modification for quickly locking the jaws of a pipe wrench.

To provide a simple modification of a pipe wrench providing a jaw locking mechanism.

Other objects and advantages of this invention are taught in the following description and claims.

BRIEF DESCRIPTION OF THE DRAWINGS

The description of this invention is to be read in conjunction with the following drawings.

DESCRIPTION OF THE PREFERRED EMBODIMENT OF THE INVENTION

Figure 1:
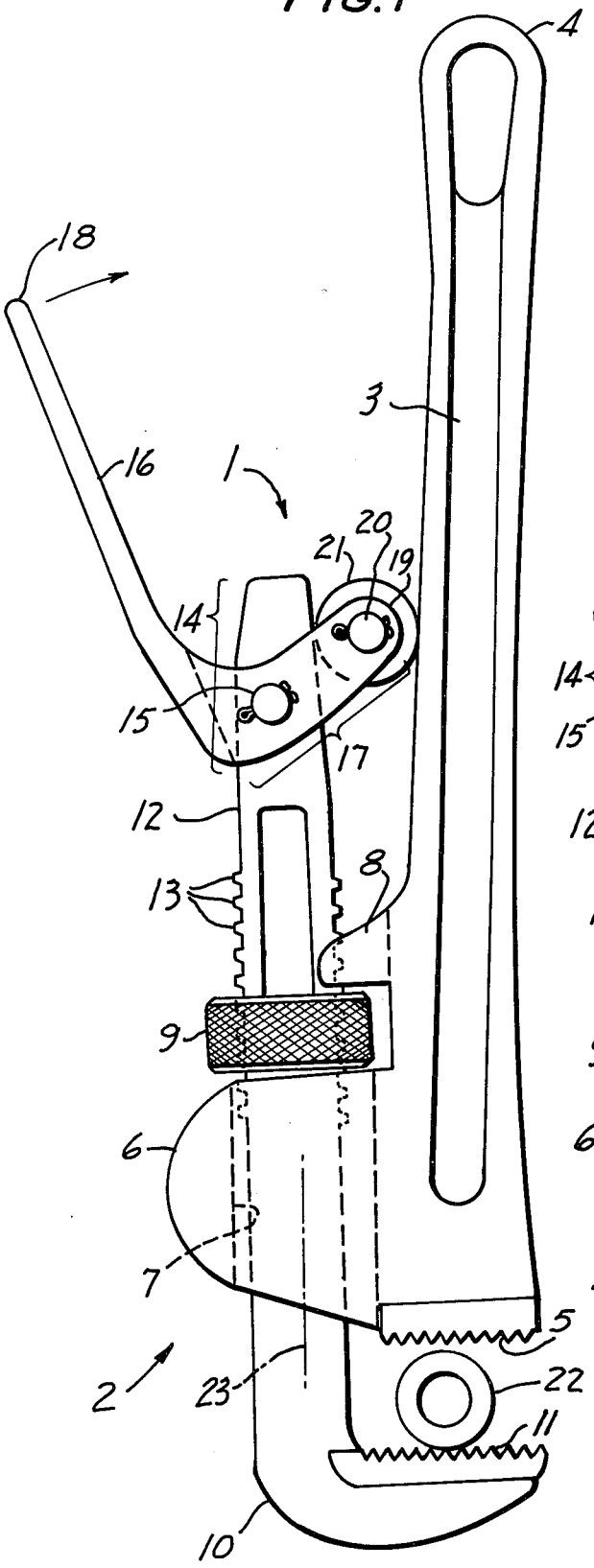
FIG. 1 is an elevational perspective view of the wrench locking device of this invention.
Figure 2:
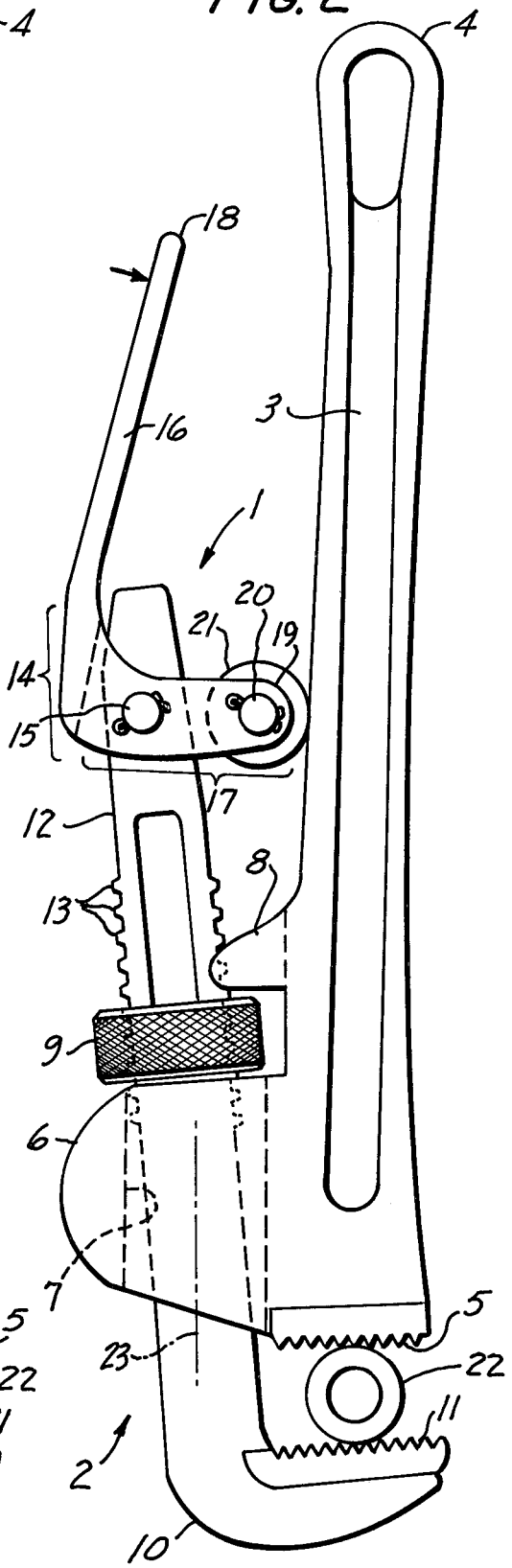
FIG. 2 is an obverse perspective view of the wrench locking device of FIG. 1.

A pipe wrench locking device 1 is modifyingly cooperatively disposed on a conventional pipe wrench 2. The conventional pipe wrench has a linear wrench handle 3, a handle terminus 4, and a flat serrated lower jaw surface 5. A first projection 6 is disposed on the handle 3 adjacent to the lower jaw surface 5, and the projection 6 has an adaptively sized tunnel 7 disposed there through, whose linear axis 23 is slightly divergently disposed to the handle 3. A second projection 8 is adaptively sized and spaced below the projection 6. The second projection 8 is a clevis paired projection sized to hold and retain the adjustment nut 9, which secures a first L-shaped upper movable jaw 10 of the pipe wrench. The jaw 10 has a short serrated jaw 11 and a long linear lever arm 12 having threads 13 permanently disposed thereon. The threads 13 are threadedly coupled to the adjustment nut 9. The tunnel 7 and clevis projection 8 are adaptively sized and disposed to slidingly accommodate the linear lever arm 12.

The cooperative pipe wrench locking device 1 has an integral coaxial linear extention 14 of arm 12 having a required length value. A fixed pivot 15 is disposed through the extension 14 and through a second L-shaped lever arm 16 which has a bisecting clevis short arm segment 17, both lever arm 16 and its short arm segment 17 are adaptively sized as required. The lever arm 16 has a first terminus 18, and a second terminus 19 at the clevis segment 17. A free pivot 20 is disposed through segment 17 adjacent the second terminus 19, the pivot 20 pivotedly securing a hardened roller 21 of the required size.

Operatively, the pipe jaws 5 and 11 are adjusted by adjustment 9 to lightly grip a pipe 22. The lever arm 16 is pressed toward the handle 3, moving roller 21 along the handle 3, finally adaptively moving roller 21 into a locking position by canting lever arm 12 into a compressive lock of jaws 5 and 11.

Many modifications in the pipe wrench locking device can be made in the light of my teachings. It is understood that within the scope of the claims, the invention can be practiced otherwise than as described.

I claim:

1. In a conventional pipe wrench having a linear wrench handle with a flat serrated lower jaw surface, a first projection adjacent to said lower jaw surface having an adaptively sized tunnel disposed there through said projection, the tunnel linear axis being slightly divergent to said handle, a second clevis projection disposed and spaced from said first projection providing a spaced position there between for an adjustment nut, and a first L-shaped upper movable jaw of the pipe wrench having a short serrated jaw and a long linear lever arm having threads disposed thereon, said first L-shaped upper movable jaw disposed in said tunnel and said clevis, the pipe wrench locking device cooperatively disposed in combination with the above comprising:

an integral coaxial extension of said linear lever arm, said extension having an adaptively sized length, a fixed pivot disposed through aforesaid lever arm coaxial extension, a second L-shaped lever arm having a bisecting clevis short arm segment, said second L-shaped lever arm pivotedly secured to said above coaxial extension by said fixed pivot, said second L-shaped lever arm having a first terminus, and a second terminus adjacent said clevis short arm segment, a free pivot disposed through said short arm clevis segment adjacent said second terminus of said second L-shaped lever arm, and, a roller disposed in said short arm clevis segment, said roller rotatively disposed on said free pivot, aforesaid pipe wrench locking device components adaptively sized to provide a second L-shaped lever arm movement rolling said roller along said handle and locking said upper and lower wrench jaws.

* * * * *